US006516784B1

(12) United States Patent
Shingu

(10) Patent No.: US 6,516,784 B1
(45) Date of Patent: Feb. 11, 2003

(54) PRESSURE ACCUMULATING DISTRIBUTION TYPE FUEL INJECTION PUMP

(75) Inventor: Kenji Shingu, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 0 days.

(21) Appl. No.: 09/744,810

(22) PCT Filed: Nov. 9, 2000

(86) PCT No.: PCT/JP00/07912

§ 371 (c)(1),
(2), (4) Date: Mar. 26, 2001

(87) PCT Pub. No.: WO02/38941

PCT Pub. Date: May 16, 2002

(51) Int. Cl.[7] ..... F02M 7/00
(52) U.S. Cl. ..... 123/450; 123/447
(58) Field of Search ..... 123/450, 451, 123/447, 458, 446; 417/462, 206, 221, 269, 273, 487

(56) References Cited

U.S. PATENT DOCUMENTS 4,407,250 A * 10/1983 Eheim et al. ..... 123/450
4,976,236 A * 12/1990 Brunel ..... 125/300
5,020,498 A * 6/1991 Linder et al. ..... 123/450
5,078,113 A * 1/1992 Haag et al. ..... 123/447
5,641,274 A * 6/1997 Kubo et al. ..... 417/206

FOREIGN PATENT DOCUMENTS

JP 62165440 * 10/1987
JP 5-288127 11/1993
JP 7-509042 10/1995
JP 09079100 * 3/1997

* cited by examiner

*Primary Examiner*—Willis R. Wolfe
*Assistant Examiner*—Mahmoud Gimie
(74) *Attorney, Agent, or Firm*—Sterne, Kessler, Goldstein & Fox PLLC

(57) ABSTRACT

There is disclosed a pressure accumulating distribution type fuel injection pump of a low pollution diesel engine which provides a low fuel economy and which can correspond to the regulation of exhaust emission. The pressure accumulating distribution type fuel injection pump (1) is provided for supplying respective cylinders with fuel that is high-pressured and accumulated in pressure accumulation chambers (31) through a distribution shaft (9). In the fuel injection pump, function members constituting a high-pressure path, such as a plunger (7), an injection control valve (26) for fuel injection control, the pressure accumulation chambers (31), the distribution shaft (9) or the like are arranged in a hydraulic base Hb. One plunger portion is provided for pressure-supplying fuel to the pressure accumulation chambers (31).

16 Claims, 10 Drawing Sheets

PRESSURE ACCUMULATING DISTRIBUTION TYPE FUEL INJECTION PUMP

BACKGROUND OF THE INVENTION

1. Field of the Invention

The present invention relates to an electrically controlled pressure accumulating distribution type fuel injection pump for supplying high-pressured fuel accumulated in a pressure accumulation chamber is distributed to each cylinder and supplied.

2. Background Art

In recent years, under the tendency that a regulation on an exhaust emission becomes strict, a diesel engine is desired so as to reduce NOx and particles or the like in exhaust gas while having low fuel economy. In order to cope with this problem, a fuel injection pressure is heightened so as to improve fuel efficiency.

Then, there is increasing an electrically controlled pressure accumulation style fuel injection pump that can arbitrarily control its injection pressure irrespective of the rotary speed of the engine while enabling the fuel injection pressure to be heightened.

This kind of pressure accumulating fuel injection type fuel injection pump aims at supplying high-pressure fuel accumulated in its pressure accumulation chamber to each cylinder, as is described, for example, in Japanese Unexamined Patent Publication No. HEI 7-509042.

The pressure accumulating fuel injection pump comprises a fuel pressure accumulation chamber, a plunger for pressure-supplying high-pressure fuel, an injection control valve for fuel injection control, distribution means for distributing fuel to each cylinder, and a pressure control valve. They serve as function members constituting a high-pressure path to which a high pressure is applied at all times. These function members are separated and accommodated in respective casings or blocks formed separately from one another.

In this manner, since the high-pressure is also applied to connection portions among such separately structured function members, the strength thereof is hard to be secured. In some cases, fuel leakage and damage are likely to be generated therefrom, thereby lowering their reliability. Also, their structures are complicated.

Furthermore, the pressure accumulating fuel injection pump is provided with a plurality of plunger chambers for pressure-supplying fuel to the pressure accumulation chamber. Since the plurality of plunger portions are juxtaposed in the direction of a camshaft, the pressure accumulation fuel injection pump becomes large and complicated.

DISCLOSURE OF THE INVENTION

The present invention provides a pressure accumulating distribution type fuel injection pump for distributing and supplying high-pressure fuel accumulated in one or a plurality of pressure accumulation chambers thereof to each cylinder through its distribution means, wherein function members constituting a highpressure path are arranged in a hydraulic base. The function members include a plunger, a pressure control valve, a fuel injection control valve, the pressure accumulation chamber or chambers, and distribution means. As a consequence, the strength of these constituent members for the high pressure path arranged together in the hydraulic base can be sufficiently secured while a high pressure is applied thereto at all times. Furthermore, the constituent members can be connected with one another through hydraulic channels constituted of drill holes or the like formed in the hydraulic base without joint members or the like so that fuel leakage and damage on the piping are not generated, thereby improving reliability.

Furthermore, the present invention is such that a distribution shaft serving as the distribution means is arranged perpendicularly to a camshaft. As a consequence, the size of the fuel injection pump can be reduced in the direction of the camshaft. Furthermore, In a small-size engine, delivery valve holders can project upwardly so as to shorten delivery pipes extended therefrom to respective injection nozzles. Consequently, the fuel volume in the injection pipes decreases so as to make the injection delay smaller, thereby enabling the injection ratio and period to be controlled in a high precision over a wide scope of rotation.

Furthermore, the present invention is such that the camshaft for driving the plunger also drives the distribution shaft. As a consequence, the fuel passage which reaches the delivery valves through the distribution shaft from the plunger portion is shortened so as to decrease the fuel volume therein, thereby heightening the quality of injection control such as ratio and period controlling of minute quantities of pilot and post injections, initial injection and so on.

Furthermore, the present invention is such that one plunger portion is provided for pressure accumulating fuel to the pressure accumulation chamber or chambers. As a consequence, the fuel injection pump can be reduced in size, and the number of parts can be reduced, thereby facilitating the manufacture and saving costs thereof.

Furthermore, the present invention is such that a cam for driving the plunger in the plunger portion is formed separately from the camshaft. Particularly if the fuel injection pump is formed for multiple cylinders, while the cam, which abuts against a tappet under high surface pressure because the curvature of its surface in contact with the tappet becomes small, is made of high surface-pressure proof material such as SKH, SKD or ceramic so as to be heightened in its endurance against friction, the camshaft can be formed of material whose strength is reduced in comparison with the material of the cam, thereby saving costs.

Furthermore, the present invention is such that a pulse generator for differentiating cylinders is provided on the camshaft of the above-mentioned pressure accumulating distribution type fuel injection pump and is integrally formed with the cam. Such a combination of parts can effect to reduce the number of parts, thereby reducing the manufacturing cost and size of the fuel injection pump.

Furthermore, the present invention is such that the rotary speed of the camshaft for driving the plunger for pressure-supplying fuel to the pressure accumulation chamber or chambers is set to the same as the output rotary speed of the engine on which the pressure accumulating distribution type fuel injection pump is attached, and the rotary speed of the distribution means is set to a half of the output rotary speed of the engine. As a consequence, for example, in the case of a four-cycle engine, the number of the cam projections can be reduced to a half of that of cylinders, thereby reducing the size of the cam and the number of steps for processing the cam.

Also, the cam profile can be reduced to half speed and their external peripheral surface can be formed into convex so that the cam can be easily ground by a diametrically large grindstone, thereby reducing the time and cost for processing the cam.

Furthermore, the present invention is such that the camshaft drives the distribution means via bevel gears, and the gear teeth of the bevel gear on the side of the distribution means are set to be twice as many as the gear teeth of the other gear on the side of the camshaft. As a consequence, with a simple structure and at a low cost, the rotary speed of the distribution means can be set to a half of the rotary speed of the camshaft.

Furthermore, the present invention is such that, while both end portions of the camshaft are supported by supporting portions of a housing, a bearing for supporting the peripheral surface of the camshaft opposite to the plunger is shifted from the supporting portions of the housing toward the center of the camshaft so as to be arranged in the vicinity of the cam. As a consequence, the load which the camshaft receives from the plunger or the like can be received with the bearing thereby making it possible to suppress a warp of the camshaft and reduce the vibration and noise. Besides, the size of the bevel gear can be formed in a small size, and the fuel injection pump can be reduced in size on the whole.

Furthermore, the present invention is such that the pressure control valve and the injection control valve for the pressure accumulation of the plunger portion, which are function members of the control system, are respectively arranged perpendicularly to the camshaft, thereby reducing the size of the fuel injection pump in the direction of the camshaft so as to minimize the whole of the fuel injection pump. Besides, if the camshaft is arranged horizontally, the axes of the pressure control valve and the injection control valve become vertical so as to prevent their slipping portions from eccentric friction.

Furthermore, the present invention is such that the pressure control valve for pressure accumulation of the plunger portion, the distribution means, and the injection control valve, which are function members of the control system are arranged perpendicularly to the camshaft respectively. As a consequence, the size of the fuel injection pump in the direction of the camshaft can be reduced, so that the whole size of the fuel injection pump can be reduced. Furthermore, if the camshaft is arranged horizontally, the axes of the pressure control valve for pressure accumulation, the distribution means and the injection control valve become vertical so as to prevent their slipping portions from eccentric friction.

Furthermore, the present invention is such that the above-mentioned function members of the control system are aligned in the direction of the camshaft in the order of the plunger portion, distribution means, and injection control valve. As a consequence, the size of the fuel injection pump in the direction of the camshaft can be reduced so as to reduce the whole size of the fuel injection pump.

Furthermore, the present invention is such that the plunger portion for pressure accumulation, the distribution means, and the injection control valve are arranged in series. As a consequence, the size of the fuel injection pump in the direction of the camshaft can be reduced so as to reduce the whole size of the fuel injection pump.

Furthermore, the present invention is such that the electromagnetic valve for pressure control of the plunger portion is arranged at an end portion of the plunger, and the electromagnetic valve for control of the injection control valve is arranged at the end portion of the injection control valve. As a consequence, the size of the fuel injection pump in the direction of the camshaft can be reduced so as to reduce the whole size of the fuel injection pump.

Furthermore, the present invention is such that the slide directions of the slide members of the electromagnetic control valves are set to be perpendicular to the camshaft. Each kind of the electromagnetic valves, which is only one irrespective of the number of cylinders, must be operated at the number of the cylinders every one rotation of the camshaft so that its operation is required to be extremely rapid and frequent, and furthermore, to be high-precision and harsh for controlling the quantity and period of injection to high-precision. However, the electro-magnetic control valves can be prevented from generation of eccentric friction on their slide portions during their rapid and frequent operations so as to improve their endurance and reliability because valve bodies serving as slide members of the electric-magnetic control valves are arranged so as to slide substantially perpendicular to the axis of the camshaft.

Furthermore, the present invention is such that a plurality of pressure accumulation chambers are arranged in parallel to each other. As a consequence, the oil passages connecting the respective pressure accumulation chambers with the plunger chamber for detaining fuel to be pressure-supplied by the plunger can be shortened, thereby reducing a surplus volume of the fuel passage, the term of fuel pressure-supplying and the power loss.

DESCRIPTION OF THE PREFERRED EMBODIMENT

Figure 1:
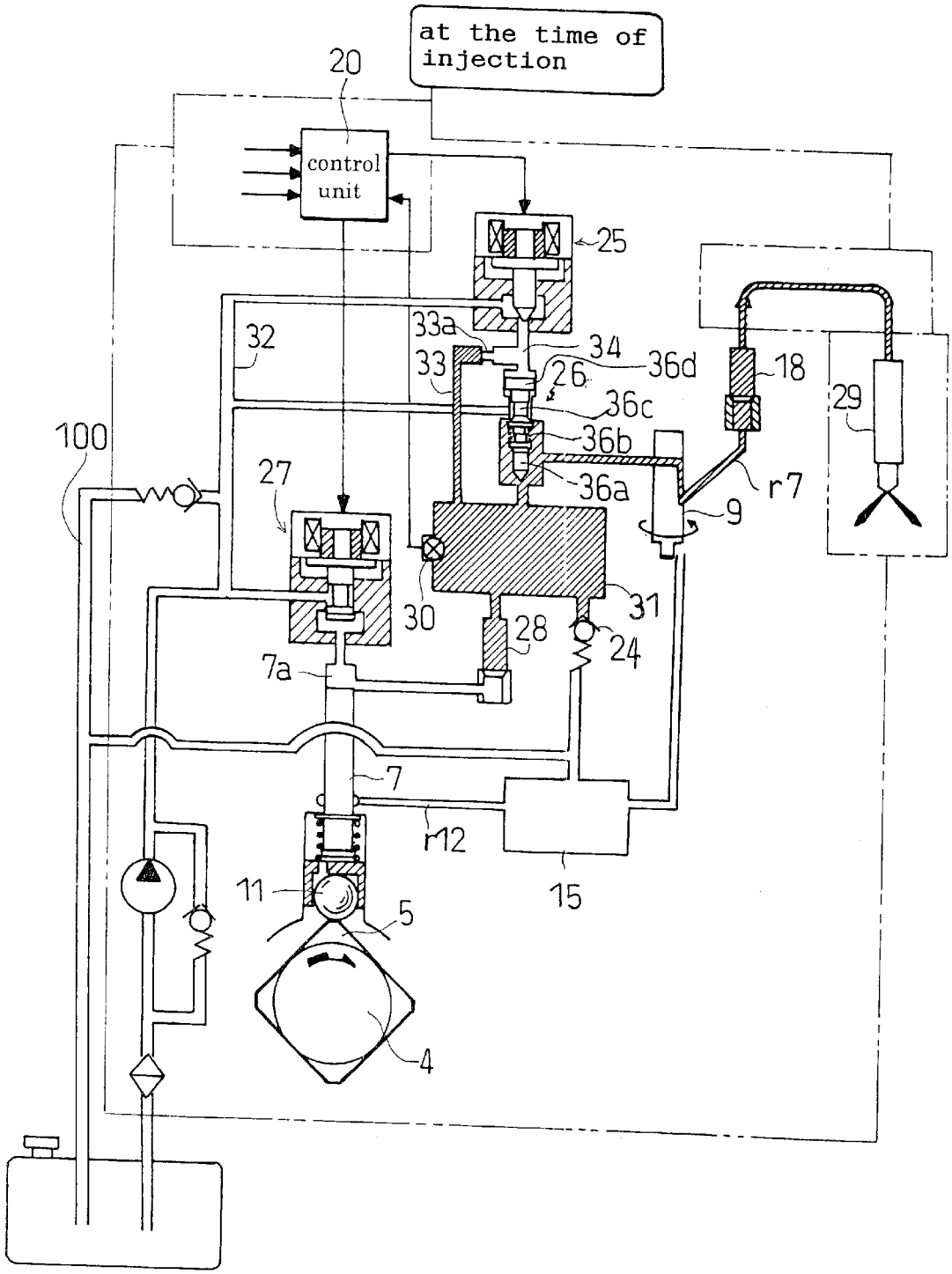
FIG. 1 is a schematic view showing a state of a fuel injection pump according to the present invention, wherein the pump injects fuel.

The present invention will be described in detail in accordance with the accompanied drawings.

In the beginning, there will be described a schematic structure of the pressure accumulating distribution type fuel injection pump according to the present invention. As shown in FIGS. 1, 2 and 3 to 5, a pressure accumulating distribution type fuel injection pump 1 comprises pressure accumulation chambers 31 in which high-pressured fuel is accumulated, a plunger 7 for pressure-supplying fuel to the pressure accumulation chambers 31, and a distribution shaft 9 for distributively supplying injection nozzles 29 of respective cylinders with the fuel pressure-supplied from the pressure accumulation chambers 31.

The plunger 7 is vertically slidably driven via a tappet 11 with a cam 5 formed on a camshaft 4, and a plunger chamber 7*a* formed above the plunger 7 is connected to the pressure accumulation chambers 31 via a check valve 28.

Furthermore, the plunger chamber 7*a* is connected to a lower-pressure circuit 32 via a pressure control valve 27.

When the pressure control valve 27 is turned on, the plunger chamber 7*a* and the lower-pressure circuit 32 are severed from each other, and when the pressure control valve 27 is turned off, the plunger chamber 7*a* and the lower-pressure circuit 32 can be connected to each other.

The pressure accumulation chambers 31 and the distribution shaft 9 are connected via an injection control valve 26. The distribution shaft 9 can be brought into communication with delivery valves 18 connected to the respective injection nozzles 29 provided on respective cylinders. A pressure sensor 30 is provided for detecting the inner-pressure of the pressure accumulation chambers 31. Furthermore, a safety valve 24 is connected to the pressure accumulation chamber 31 so that, when the inner-pressure of the pressure accumulation chambers 31 becomes a definite degree or more, the pressure is allowed to escape toward the lower-pressure circuit 32.

The injection control valve 26 includes a lower valve 36*a*, an upper valve 36*c* and a piston 36*d*, which are slidably accommodated. The lower valve 36*a* is biased toward the side of the pressure accumulation chambers 31 by a spring 36*a*.

Furthermore, the injection control valve 26 is constituted into a three-direction valve. When the lower valve 36*a* is slidden to the opposite side of the pressure accumulation chambers 31, the pressure accumulation chamber 31 is connected to the distribution shaft 9 so as to communicate with the injection nozzle 29 through the delivery valves 18. On the contrary, when the lower valve 36*a* is slidden to the side of the accumulation chamber 31, only the lower-pressure circuit 32 and an oil passage r7 which reaches the delivery valve 18 via the distribution shaft 9 are connected to each other.

The end portion of the injection control valve 26 on the opposite side of the pressure accumulation chambers 31 is connected to a pilot valve 25 through a connection passage 34, and the connection passage 34 is connected to the pressure accumulation chambers 31 via a bypass circuit 33.

The pilot valve 25 severs the connection and disconnection between the connection passage 34 and the lower-pressure circuit 32. When the pilot valve 25 is turned on, the connection passage 34 and the lower-pressure circuit 32 are connected to each other, and when the pilot valve 25 is turned off, the connection passage 34 and the lower-pressure circuit 32 are severed from each other.

Furthermore, the pilot valve 25, the pressure control valve 27 and the pressure sensor 30 are connected to an electronic control unit (hereinafter referred to as ECU) 20.

In the fuel injection pump 1 constituted in this manner, the plunger chamber 7*a* is supplied with fuel from a fuel tank. At the time of pressure accumulation, as shown in FIG. 1, the pressure control valve 27 is turned on with the control of the ECU 20, so that the plunger chamber 7*a* and the lower-pressure circuit 32 are severed from each other, and the fuel in the plunger chamber 7*a* is compressed by the plunger 7 which is slidden upward with the cam 5 so as to be pressure-supplied into the pressure accumulation chambers 31.

The check valve 28 prevents the fuel pressure-supplied to the pressure accumulation chambers 31 from back-flowing with the result that appropriate pressure is accumulated in the pressure accumulation chambers 31.

Figure 2:
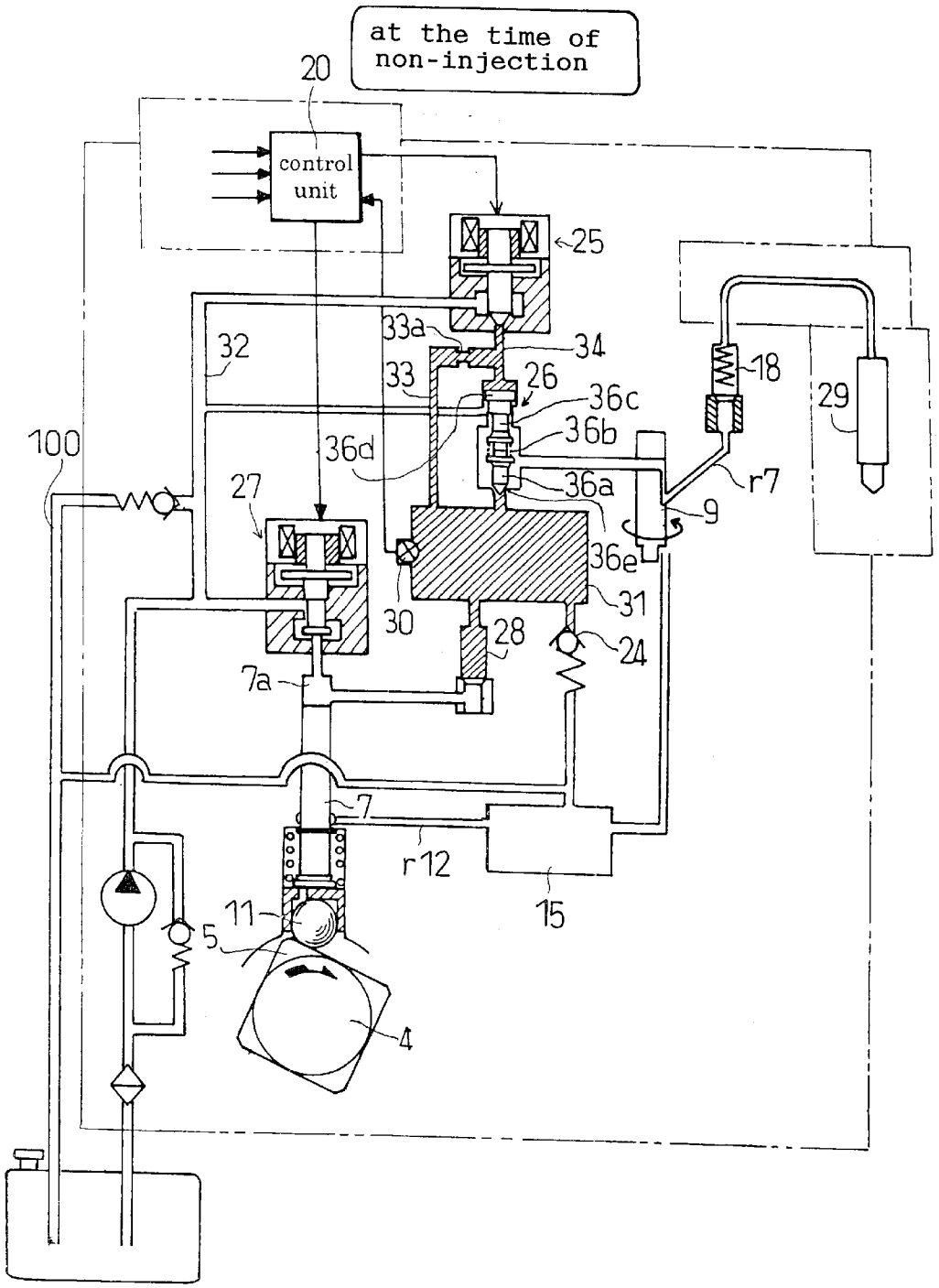
FIG. 2 is a schematic view showing another state of the same fuel injection pump, wherein the pump injects no fuel.

On the other hand, when the pressure accumulation is not required, as shown in FIG. 2, the pressure control valve 27 is turned off, and the plunger chamber 7*a* and the lower-pressure circuit 32 are connected to each other so that the fuel in the plunger chamber 7*a* is drained to the low pressure circuit 32.

The connection passage 34 in connection with the pressure accumulation chambers 31 through the bypass circuit 33 is supplied with the fuel from the pressure accumulation chambers 31 via an orifice 33a. At the time of fuel injection, the pilot valve 25 of the injection control valve 26 is turned on with the control of the ECU 20 so that the connection passage 34 and the lower-pressure circuit 32 are connected to each other so as to lower the pressure of the connection passage 34. Consequently, the pressure application of the piston 36*d* of the injection control valve 26 toward the pressure accumulation chambers 31 is released.

Accordingly, the lower valve 36*a* is energized by the pressure of the pressure accumulation chambers 31 so as to be slidden in opposite to the pressure accumulation chambers 31, thereby connecting the pressure accumulation chambers 31 to the distribution shaft 9.

Consequently, the fuel in the pressure accumulation chambers 31 is pressure-supplied to the distribution shaft 9 to be distributed to each cylinder so that fuel is injected from the injection nozzle 29 via the delivery valve 18.

On the other hand, for the non-injection of fuel, as shown in FIG. 2, the ECU 20 controls the pilot valve 25 to turn off so that the connection passage 34 to which fuel is supplied from the pressure accumulation chambers 31 via the orifice 33*a* is severed from the lower-pressure circuit 32. Therefore, the pressure in the connection passage 34 is raised, and the piston 36*d* of the injection control valve 26 is pressured toward the pressure accumulation chamber 31.

As a consequence, the lower valve 36*a* is slidden toward the pressure accumulation chamber 31 via the upper valve 36*c* so as to fit on a seat 36*e*. At the same time, the fuel passages r6 and r7 from the injection control valve 26 to the delivery valve 18 are connected to the lower-pressure circuit 32, whereby their pressure becomes the drain pressure so as to complete the injection.

Incidentally, a spring 36*b* which biases the lower valve 36*a* toward the pressure accumulation chambers 31 is a spring for raising the initial pressure of the pressure accumulation chamber 31 at the time of the start-up.

Next, there will be described an arrangement structure of each of constituent members of the fuel injection pump 1 such as the plunger 7, the pressure accumulation chamber 31, the distribution shaft 9, the pressure control valve 27 and the pilot valve 25 or the like.

Figure 3:
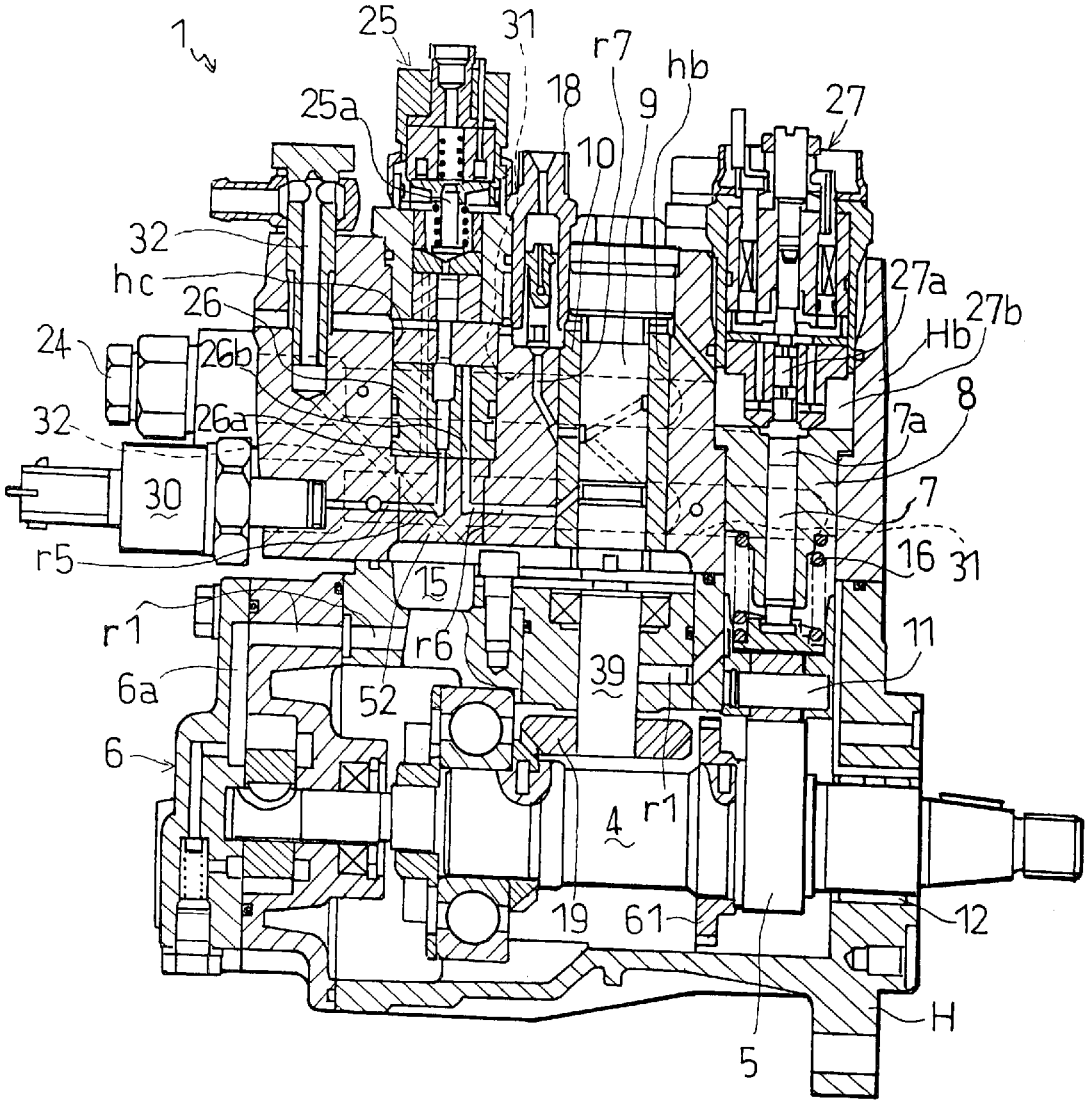
FIG. 3 is a sectional side view of the fuel injection pump.
Figure 4:
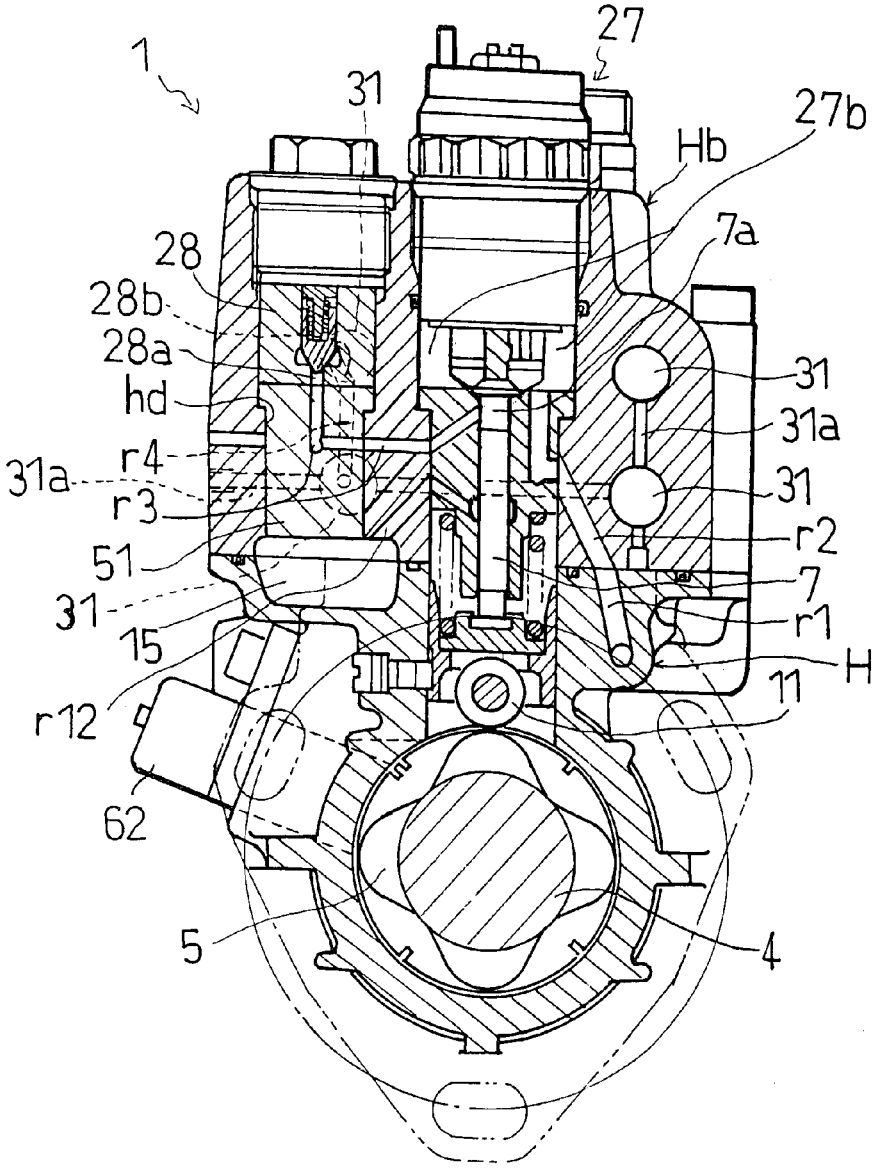
FIG. 4 is a sectional front view of the same.
Figure 5:
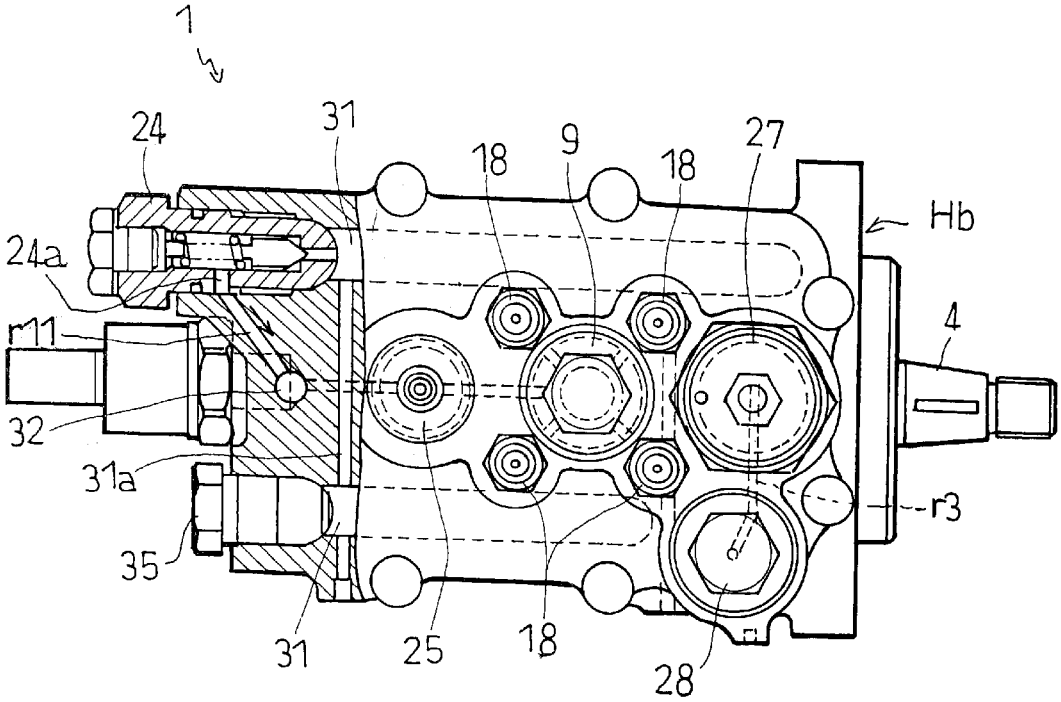
FIG. 5 is a plan view partly in sectional of the same.

As shown in FIGS. 3 through 5, on the lower portion of the fuel injection pump 1, the camshaft 4 is provided for fixing the cam 5 thereon. One end portion of the camshaft 4 is journalled to a camshaft housing H through a cam bearing 12.

A hydraulic base Hb made of a bloc-like member is arranged above the camshaft housing H. The hydraulic base Hb serves as a housing of constituent members such as the plunger 7, the pressure accumulation chamber 31, the distribution shaft 9 and the like.

Above the cam 5, the plunger 7 is arranged substantially perpendicularly to the axis of the camshaft 4. The plunger 7 is vertically slidably inserted into a plunger barrel 8 fit into the hydraulic base Hb. The plunger 7 is provided on the lower end thereof with a tappet 11.

The plunger 7 and the tappet 11 are biased downward by biasing means such as a spring 16 or the like with the result that the tappet 11 comes into contact with the cam 5 and the plunger 7 is moved in a reciprocal movement with the rotation of the cam 5.

A plunger portion comprising the plunger 7, the plunger chamber 7*a* formed above the plunger 7, the pressure control valve 27, the tappet 11, the cam 5 and the like is provided in the fuel injection pump 1 for pressure-supplying fuel to the pressure accumulation chambers 31.

In this manner, the fuel injection pump 1 is reduced in size by providing only one plunger portion and, at the same time, the number of parts can be decreased thereby making it possible to facilitate the structure and lower the cost thereof.

Furthermore, on the upper end portion of the plunger 7 is arranged the pressure control valve 27 as an electromagnetic valve for pressure-supplying the plunger 7 with fuel. The pressure control valve 27 is arranged, for example, as shown in FIG. 3, in such a manner that a valve body 27*a* slides substantially perpendicularly to the axis of the camshaft 4, namely, in a vertical direction. However, the arrangement direction of the pressure control valve 27 is not restricted to such a vertical direction.

In this manner, the size of the camshaft 4 of the fuel injection pump 1 in the axial direction of the camshaft 4 can be made small by arranging the pressure control valve 27 on the upper end portion of the plunger 7, thereby making it possible to reduce the size of the fuel injection pump 1 on the whole.

Besides, the pressure control valve 27 which is only one irrespective of the number of cylinders, while being necessarily operated at a very high speed and at so many times as the number of cylinders every one rotation of the camshaft 4 and being required to keep its high precision and harsh operation for controlling in a high precision the pressure of the pressure accumulation chambers 31, is improved in its endurance and reliability because of its arrangement wherein its valve body 27*a* slides substantially perpendicularly to the axis of the camshaft 4 so as to be prevented at its slipping portion from eccentric friction.

The distribution shaft 9 is arranged on a side of the plunger 7 so that their axes are parallel to each other. The distribution shaft 9 is rotatably inserted into a distribution shaft sleeve 10 fit into the hydraulic base Hb. A distribution drive shaft 39 is connected with the bottom end of the distribution shaft 9 so as to drive the distribution shaft 9 into rotation.

The distribution drive shaft 39 and the distribution shaft 9 are arranged substantially perpendicularly to the axis of the camshaft 4. Bevel gears 19 engage so as to connect the distribution drive shaft 39 with the camshaft 4. As a consequence, the camshaft 4 rotationally drives the distribution shaft 9 via the bevel gears 19.

Due to such an arrangement and such a structure, the fuel passage (fuel passages r6 and r7 or the like described later) which reaches from the plunger portion including the plunger 7 up to the delivery valve 18 through the distribution shaft 9 is shortened so that the fuel volume inside of the fuel passage can be decreased, thereby making it possible to enhance the quality of injection, for example, the ratio-and-timing control of injections such as a small amount pilot injection, a post injection, and an initial injection by use of the electro-magnetic valves such as the pilot valve 25 and the pressure control valve 27.

On the periphery of the distribution shaft 9 in the hydraulic base Hb are fit the delivery valves 18 as many as the cylinders.

Even if the camshaft 4 and the distribution shaft 9 are not arranged perpendicularly to each other, it is possible to provide the above effect when the camshaft 4 and the distribution shaft 9 are arranged through a certain angle.

In the hydraulic base Hb, the injection control valve 26 is fit into a side portion of the distribution shaft 9 in opposite to the plunger 7 and is arranged substantially perpendicularly to the axis of the camshaft 4. In other words, the injection control valve 26 is arranged so that the upper and lower valves 36*c* and 36*a* are slidden substantially perpendicularly to the axis of the camshaft 4.

On the upper end portion of the injection control valve 26 is arranged the pilot valve 25 so that its valve body 25*a* slides substantially perpendicularly to the axis of the camshaft 4, namely in a vertical direction.

Such an arrangement of the pilot valve 25 on the upper end of the injection control valve 26 can effectively reduce the size of the camshaft 4 of the fuel injection pump 1 in its axial direction, thereby reducing the size of the fuel injection pump 1 on the whole.

Furthermore, similarly to the pressure control valve 27, each of the injection control valve 26 and the electromagnetic pilot valve 25, which is only one irrespective of the number of cylinders, can be improved in its endurance and reliability because it is prevented from eccentric friction on its slipping portion while being operated rapidly and frequently.

The plunger 7, the distribution shaft 9, and the injection control valve 26, which are function members of the control system of the fuel injection pump 1, are arranged in the order from one end portion of the hydraulic base Hb in a line along the axis of the camshaft 4.

In this manner, the plunger 7, the distribution shaft 9, and the injection control valve 26 are arranged in a line while locating the distribution shaft 9 in the middle portion, so that the size of the camshaft 4 of the fuel injection pump 1 in its axial direction can be reduced, thereby making it possible to reduce the size of the fuel injection pump 1 on the whole.

A pressure sensor 30 for detecting the pressure in the pressure accumulation chambers 31 is attached on one side of the hydraulic base Hb.

It is enough that the plunger 7, the distribution shaft 9 and the injection control valve 26 are arranged approximately in a line, even if they are not arranged in a complete line or any of them is deviated from the line.

In the hydraulic base Hb is drilled a hole which is axially elongated in parallel to the axis of the camshaft 4, thereby constituting the pressure accumulation chamber 31. One or a plurality of pressure accumulation chambers 31 are constituted and mutually connected with one another through oil passages formed in the hydraulic base Hb.

The hole of the hydraulic base Hb constituting the pressure accumulation chamber 31 is outwardly open at its one end. This opening is closed with a plug 35 or the safety valve 24. For example, when a plurality of the holes serving as the pressure accumulation chambers 31 are provided, one of the holes is plugged at its opening with the safety valve 24, and the other holes are plugged at their openings with the respective plugs 35.

The plurality of pressure accumulation chambers 31 are arranged in parallel to one another in the vicinity of the function members of the control system such as the plunger 7, the distribution shaft 9, and the injection control valve 26.

Due to such a parallel arrangement of the plurality of pressure accumulation chambers 31 in the vicinity of the function members of the control system, the fuel passages (r3 and r4 discussed later) connecting the pressure accumulation chambers 31 and the plunger 7*a* can be formed in a short length, and the waste volume of the fuel passage can be decreased, thereby making it possible to shorten the fuel pressure-supply time and decrease loss of power.

Alternatively, the pressure accumulation chamber 31 may be disposed approximately perpendicularly to the axis of the camshaft 4. Furthermore, the pressure accumulation chamber 31 may not only be formed in a straight-line configuration or may be bent at the intermediate portion thereof.

Furthermore, even if the plurality of pressure accumulation chambers 31 are not completely parallel, it is enough that they are parallel or approximately parallel when viewed from a definite direction while being arranged from one another at a certain angle when viewed from another direction.

On one end surface of the camshaft housing H is provided a trochoid pump 6 serving as a feed pump for pressure-supplying fuel, which is driven with the rotation of the camshaft 4.

The trochoid pump 6 pressure-supplies fuel stored in a fuel tank from a fuel supplying chamber 27*b* to the plunger chamber 7*a* through the fuel passage r1 drilled in the camshaft housing H and the fuel passage r2 drilled in the hydraulic base Hb.

In other words, the fuell passages r1 and r2 bring a discharge port 6*a* of the trochoid pump 6 into communication with the plunger chamber 7*a* of the plunger portion through the fuel supplying chamber 27*b* and the valve body 27*a* of the pressure control valve 27.

Then, the fuel pressure-supplied into the plunger chamber 7*a* is introduced into a check valve 28 through an fuel passage r3. The fuel is introduced from the check valve 28 to the pressure accumulation chamber 31 through the fuel passage r4.

In this manner, the trochoid pump 6 is attached on one end surface of the camshaft housing H so as to be driven with the camshaft 4. As a consequence, it is not necessary to separately provide a drive shaft for driving the trochoid pump 6 with the result that the number of parts are decreased, thereby making it possible to attempt to facilitate the structure and decrease the cost and reduce the size of fuel injection pump 1 on the whole.

Furthermore, the communication between the discharge port 6*a* of the trochoid pump 6 and the plunger chamber 7*a* of the plunger portion is established by the fuel passages r1 and r2 so as to pressure-supply fuel up to the plunger portion from the trochoid pump 6 without using a pipe member, thereby being structured simply and at low cost and making it unnecessary to consider breakage and fuel leakage with respect to a pipe.

Alternatively, the feed pump for pressure-supplying fuel may be a rotary type gear pump, a vane pump or the like other than the trochoid pump 6.

The check valve 28 is fit into a fit hole hd formed in the hydraulic base Hb. In the fit hole hd, a fuel passage piece 51 is fit below the check valve 28. fuel passage r3 formed in the fuel passage piece 51 is joined at one end thereof with the fuel passage r3 formed in the hydraulic base Hb, and joined at the other end thereof to a fuel inlet port 28*a* of the check valve 28. The fuel passage r4 formed in the fuel passage piece 51 is joined at one end thereof with the fuel passage r4 formed in the hydraulic base Hb, and joined at the other end thereof to a fuel outlet port 28*b* of the check valve 28.

In other words, the check valve 28 is connected to the fuel passages r3 and r4 formed in the hydraulic base Hb via the fuel passages r3 and r4 formed in the fuel passage piece 51, respectively.

In this manner, the fuel inlet and outlet ports 28*a* and 28*b* of the check valve 28 formed inside of the hydraulic base Hb are respectively connected to the fuel passages r3 and r4 formed in the fuel passage piece 51 serving as a separate entity from the hydraulic base Hb.

As a consequence, the fuel passages r3 and r4 for high pressured fuel can be processed and formed in the single entity of the fuel passage piece 51 separate from the hydraulic base Hb, thereby making it possible to facilitate the processing of the fuel passages r3 and r4 and reduce the number of processing steps.

The fuel passage piece 51 can be processed in higher precision than the hydraulic base Hb which has a complicated configuration and a large size, so that the surface of the fuel passage piece 51 to abut against the surface of the check valve 28 where the fuel inlet port 28*a* and the fuel outlet port 28*b* are open can be highly accurately and easily processed.

Consequently, the connection portions between the fuel passage r3 and the fuel inlet port 28*a* and between the fuel passage r4 and the fuel outlet port 28*b* can be securely sealed, thereby preventing the fuel leakage or the like.

The high-pressured fuel pressure-supplied and accumulated in the pressure accumulation chambers 31 is introduced into the injection control valve 26 through the fuel passage r5 depending on the control state of the pilot valve 25 (when the pilot valve 25 is turned on), and is introduced into the distribution shaft 9 from the injection control valve 26 through the fuel passage r6.

The injection control valve 26 is fit into a fit hole hc formed in the hydraulic base Hb, and the fuel passage piece 52 is fit into the fit hole hc so as to be located below the injection control valve 26.

The fuel passage r5 and the fuel passage r6 are formed in the fuel passage piece 52. One end portion of the fuel passage r5 formed in the fuel passage piece 52 is connected to the fuel passage r5 formed in the hydraulic base Hb while the other end portion is connected to the fuel inlet port 26*a* of the injection control valve 26. Furthermore, one end portion of the fuel passage r6 formed in the fuel passage piece 52 is connected to the fuel outlet port 26*b* of the injection control valve 26 while the other end portion thereof is connected to the fuel passage r6 formed on the hydraulic base Hb.

In other words, the injection control valve 26 is connected to the fuel passages r5 and r6 formed in the hydraulic base Hb via the fuel passages r5 and r6 formed in the fuel passage piece 52, respectively.

In this manner, the fuel passages r5 and r6 to be respectively connected to the fuel inlet and outlet ports 26*a* and 26*b* of the injection control valve 26 provided within the hydraulic base Hb are formed in the fuel passage piece 52 which is separate from the hydraulic base Hb.

As a consequence, it becomes possible to process and form the fuel passages r5 and r6 in the fuel passage piece 52 made of a single entity which is separate from the hydraulic base Hb, thereby simplifying the processing of the fuel passages r5 and r6 so as to decrease the number of processing steps.

Furthermore, in the case where the fuel passage 52 is processed as a single entity, the fuel passage piece 52 can be processed in higher precision than the hydraulic base Hb which has a complicated configuration and is made of a large member. Consequently, because the connecting sides of the fuel inlet port 26*a* and the fuel outlet portion 26*b* of the injection control valve 26 in the fuel passage piece 52 can be highly accurately and easily processed, the sealing of the connection portion between the fuel passages r5 and r6 through which the high-pressured fuel passes and the fuel inlet and outlet ports 26*a* and 26*b* can be conducted with certitude, thereby preventing the fuel leakage or the like.

Fuel supplied to the distribution shaft 9 is guided to the delivery valve 18 through the oil passage r7 corresponding to each of the cylinders to be provided with fuel injection from the injection nozzle 29 of each cylinder.

In this manner, all the function members constituting a high-pressured fuel path of the fuel injection pump 1 such as the plunger 7, the distribution shaft 9, the pressure control valve 27, the check valve 28, the injection control valve 26, the pressure sensor 7, the safety valve 24, the delivery valve 18, the pilot valve, the pressure accumulation chamber 31 and the like are arranged together in the hydraulic base Hb made of one bloc-like member.

Thus, these constituent members, to which a high pressure is constantly applied, are arranged in the one bloc-like member so that the strength of the highpressured fuel path can be sufficiently secured. Besides, any of the constituent members is connected with each other without a joint member or the like having a fear of fuel leak or damage but through the fuel passages r1, r2 . . . which are constituted of drill holes formed in the hydraulic base Hb, thereby being improved in its reliability.

Incidentally, the function members (the plunger barrel 8, and the distribution shaft sleeve 10) and the fuel passage pieces 51 and 52 or the like form a high-pressure path and is closely fit into the hydraulic base Hb by heat caulking or cold caulking.

Furthermore, a low-pressure chamber 15 is formed on the boundary portion between the hydraulic base Hb and the camshaft housing H in the lower portion of the injection control valve 26 and the distribution shaft 9.

The low pressure chamber 15 is primarily connected to a lower-pressure circuit 32 constituted of a drill hole formed in the hydraulic base Hb so that fuel leaking out from the a slit between the plunger 7 for pressure-supplying fuel to the pressure accumulation chamber 31 and the plunger barrel 8, fuel leaking out between the distribution shaft 9 and the distribution shaft sleeve 10 fit into the fit hole hb formed in the hydraulic base Hb, or the like is collected into the low pressure chamber 15 so as to be brought back to the fuel tank through a lower-pressure drain circuit 100.

Incidentally, the external peripheral portion of the plunger barrel 8 communicates with the low-pressure chamber 15 through a leak return hole r12 formed in the hydraulic base Hb.

In this manner, the low-pressure chamber 15, which serves as a fuel recycle chamber for recycling fuel from the high-pressure path including the plunger 7 and the distribution shafts 9 to the lower-pressured portion, is provided in the hydraulic base Hb and the camshaft housing H which constitute a housing of the fuel injection pump 1, so that the fuel leak from the higher-pressured path caused by the extremely heightened injection pressure of the fuel injection pump 1 can be surely collected and returned to the fuel tank.

Thus, the mixture of the leak fuel with lubrication oil in the camshaft housing H or the engine, which causes the lubrication oil to be diluted, can be prevented.

Besides, a drain port 24a of the safety valve 24 provided in the pressure accumulation chamber 31 is connected to a lower-pressured drain circuit 100 with a communication passage r11 constituted of a drill hole formed in the hydraulic base Hb with the result that fuel exhausted from the pressure accumulation chamber 31 via the safety valve 24 is returned to the fuel tank.

In this manner, the safety valve 24 and the lower-pressured drain circuit 100 can be connected with the communication passage rll as a drill hole in the hydraulic base Hb without piping members, thereby preventing a fuel leak and saving costs. Furthermore, the safety valve 24 takes the place of the plug 35 for closing the open portion of the pressure accumulation chamber 31. Then, the safety valve 24 is provided with the function of the plug 35, thereby attempting to reduce the number of parts.

Incidentally, the low-pressure chamber 15 may be connected to the inlet port of the trochoid pump 6 so as to supply the trochoid pump 6 with the fuel recycled in the low pressure chamber 15.

Next, description will be given on the fuel injection pump applied for multiple cylinders, for example, six cylinders centering on the structure of the cam 5.

Figure 6:
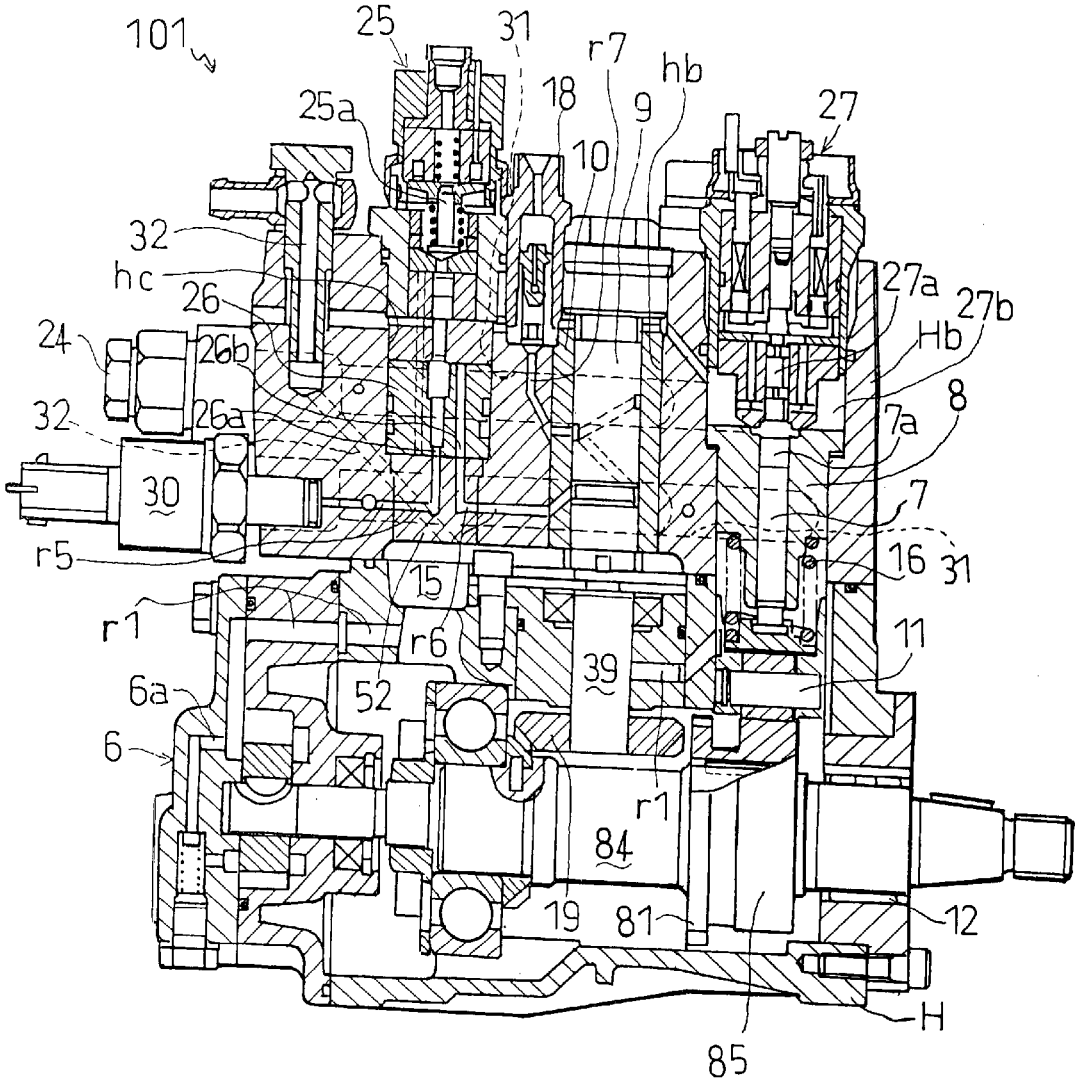
FIG. 6 is a sectional side view of a fuel injection pump according to a second embodiment of the present invention.
Figure 7:
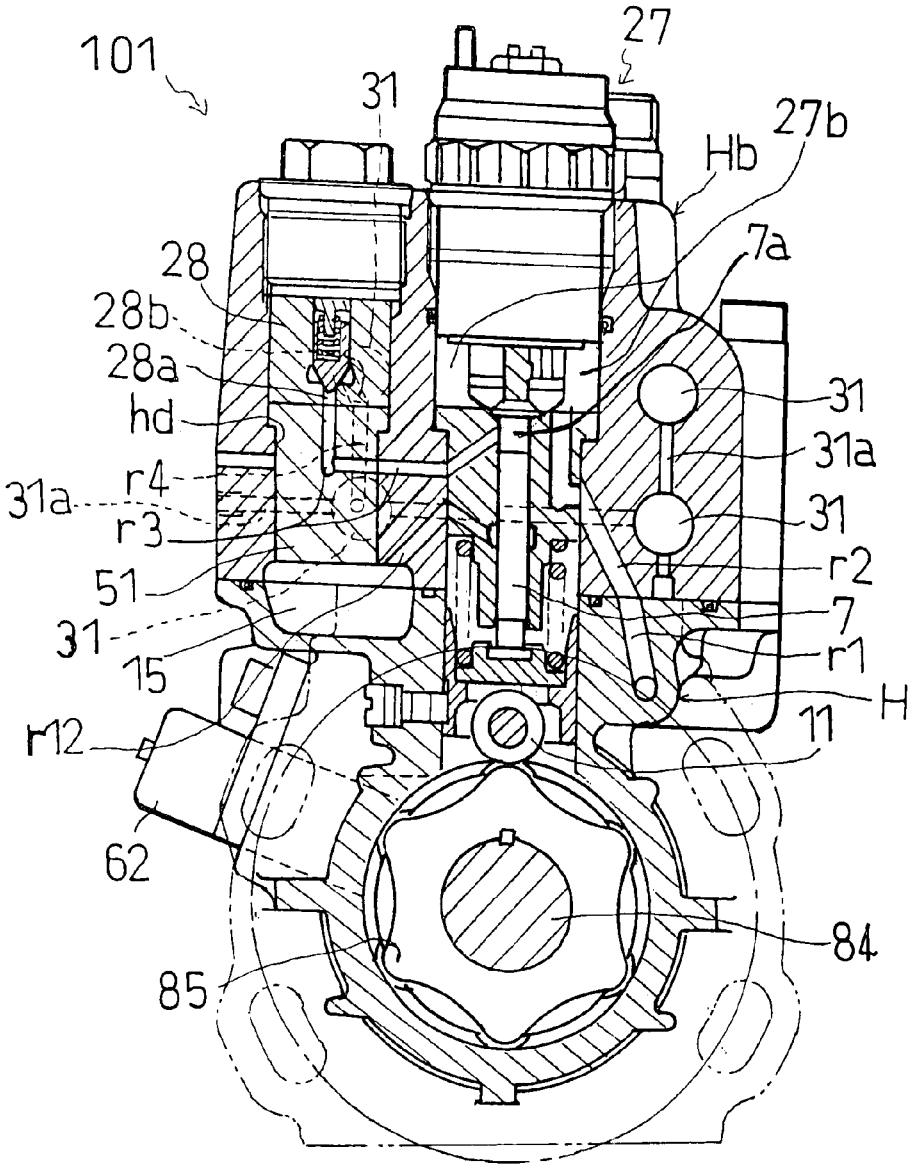
FIG. 7 is a sectional front view of the same fuel injection pump according to the second embodiment.

In a fuel injection pump 101 which is constituted for use in six cylinders as shown in FIGS. 6 and 7, a cam 85 provided with six projection portions is formed separately from a camshaft 84 and divisionally provided on the camshaft 84 so as to be rotated together. Furthermore, a cylinder differentiation pulsar 81 for differentiation of cylinders is formed integrally on the cam 85.

In the cam 85 applied for multiple cylinders, the curvature of its surface to abut against the tappet 11 becomes small so that the contact surface pressure against the tappet 11 is heightened.

However, the present fuel injection pump 101 for multiple cylinders is provided with the cam 85 and the camshaft 84 formed separately from each other. The cam 85 abutting against the tappet 11 at high pressure is constituted of high surface-pressure proof material such as SKH, SDK, ceramic or the like so as to be heightened in its endurance against friction. The camshaft 84 is formed of standard quality material that is not as strong as the cam 85, thereby attempting to reduce the cost.

Furthermore, the cam 85 made of high surface-pressure proof material is formed with the purpose of cost reduction by manufacturing methods such as sintering, MIM, and the like. At the same time, further cost reduction is intended as well as size reduction of the fuel injection pump 101 by compounding functional members through forming the cylinder differentiation pulsar 81 integrated into the cam 85.

Figure 8:
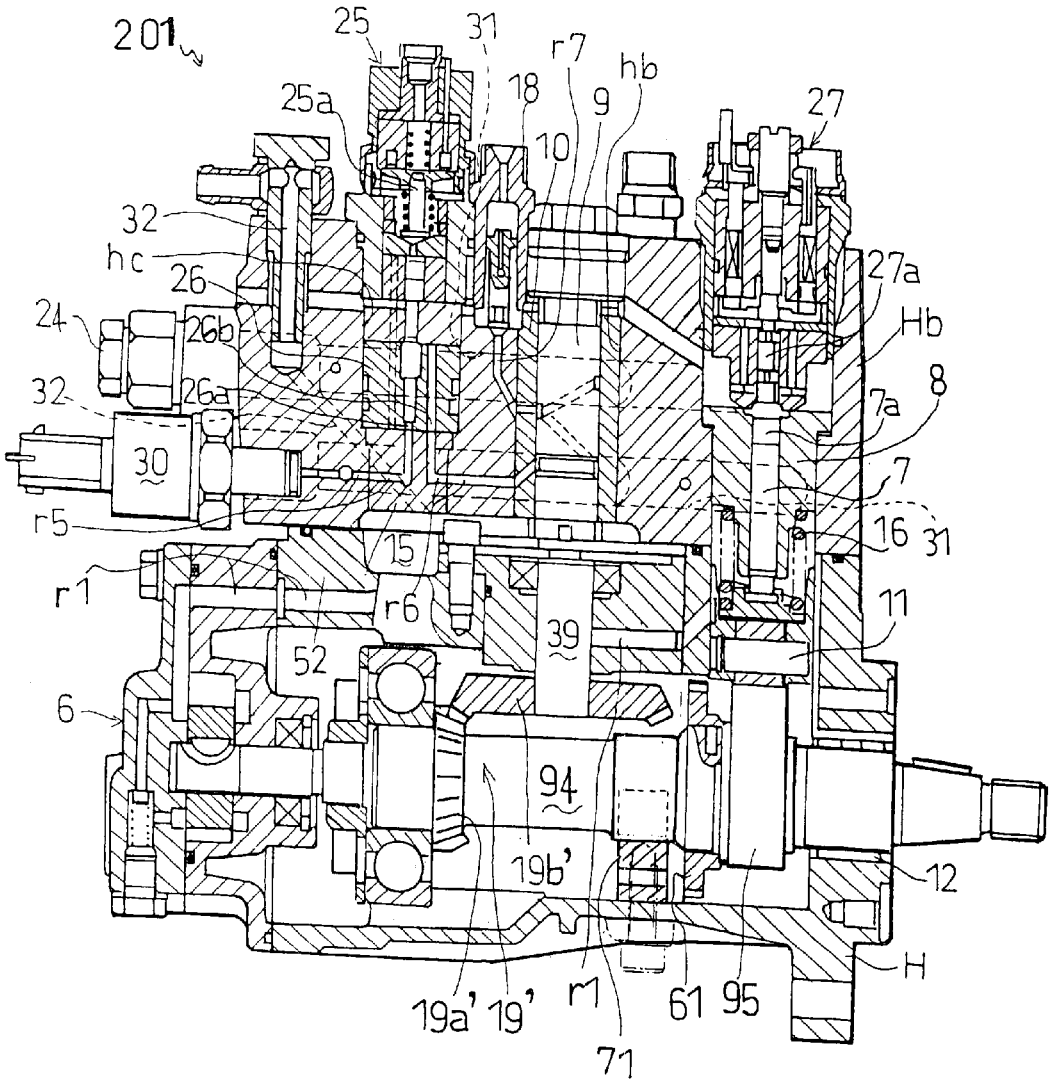
FIG. 8 is a sectional side view of a fuel injection pump according to a third embodiment of the present invention.
Figure 9:
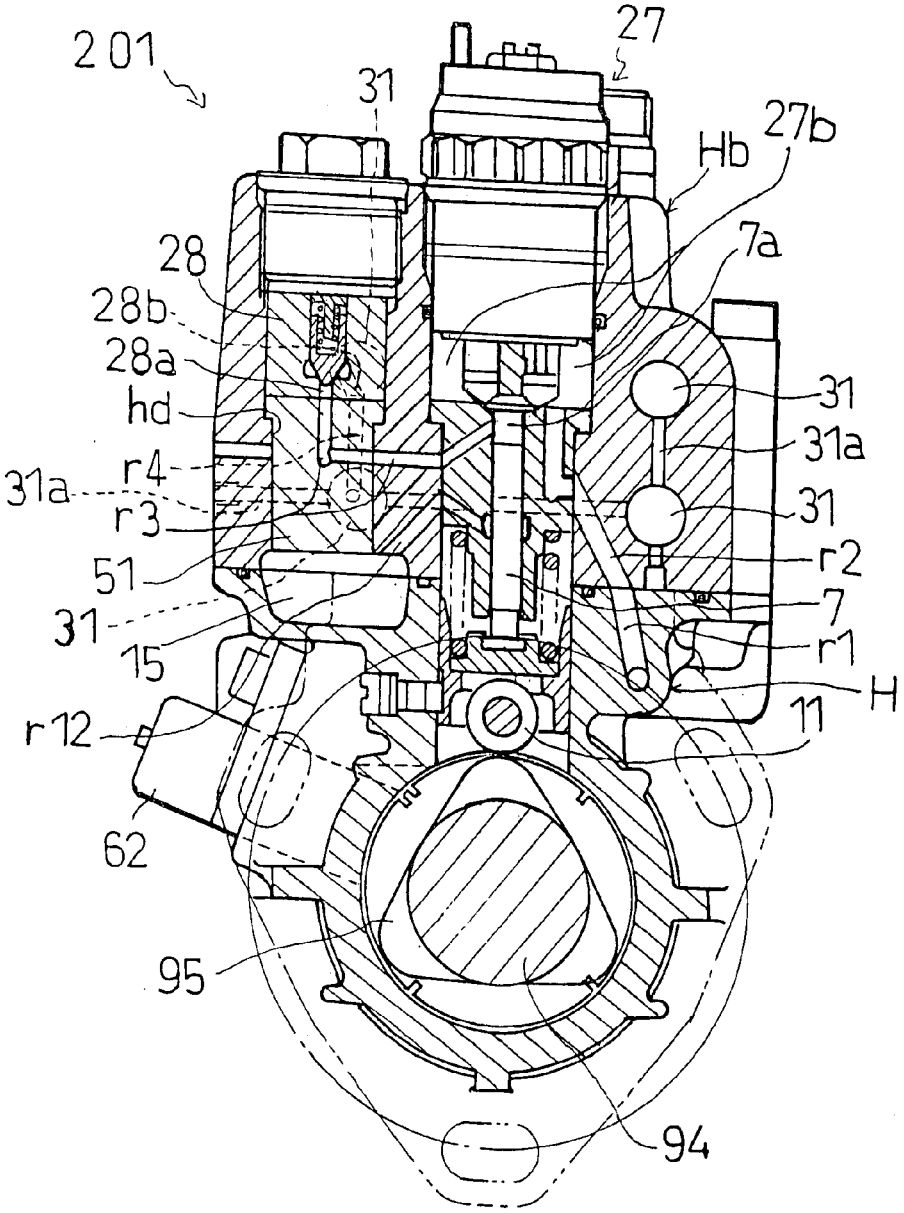
FIG. 9 is a sectional front view of the fuel injection pump according to the third embodiment.

Alternatively, a fuel injection pump to be applied for multiple cylinders may be constituted as shown in FIGS. 8 and 9.

In a fuel injection pump 201 shown in FIGS. 8 and 9, the distribution shaft 9 is driven with a camshaft 94 via bevel gears 19' constituted by a camshaft side gear 19*a*' and a distribution shaft side gear 19*b*' engaging with each other. The camshaft side gear 19*a*' is fixed on the camshaft 94, and the distribution shaft side gear 19*b*' is fixed on a distribution drive shaft 39 on the side of the distribution shaft 9.

Then, in this embodiment, the distribution shaft side gear 19*b*' has gear teeth twice as many as the camshaft side gear 19*a*'.

Furthermore, the camshaft 94 is driven at the same rotary speed as the output rotary speed of the engine on which the fuel injection pump 201 is attached. Consequently, the distribution shaft 9 is driven by the camshaft 94 so as to be rotated at a half rotary speed of the camshaft 94 via the camshaft side gear 19*a*' and the distribution shaft side gear 19*b*' having gear teeth twice as many as those of the camshaft side gear 19'*a*.

Here, the fuel injection pump 201 for multiple cylinders is applied for six cylinders, for example. In the case of a four-cycle engine, while the camshaft 4 is rotated twice, the distribution shaft 9 is rotated once for distributively supplying fuel once to each cylinder. A cam 95 has three projections so that the plunger 9 pressure-supplies fuel into the pressure accumulation chambers 31 at six times during the twice rotation of the camshaft 4.

That is, in this case, the number of projections formed on the cam 95 is half as large as the number of cylinders.

In this manner, in the case of the four-cycle engine, the number of the projections of the cam 95 can be decreased to half of the number of the cylinders so that the cam 95 can be reduced in size and in the number of its processing steps.

Furthermore, since the cam profile can be decreased to the half speed, and since the external surface of the cam 95 can be formed into an outward convex configuration, a grinding stone having a large diameter can be used for processing the external surface of the cam 95, thereby facilitating the grinding of the external surface, decreasing the processing time, and saving costs.

Furthermore, the rotary speed of the distribution shaft 9 can be set to a half speed of that of the camshaft 94 by such a simple and cheap construction that the distribution shaft 9 and the camshaft 94 are connected with each other via the bevel gears 19'.

Besides, the distribution shaft side gear 19*b*' having gear teeth twice as many as the camshaft side gear 19*a*' is diametrically larger than the camshaft side gear 19*a*'. Therefore, the diametrical minimization required to reduce the size of the fuel injection pump 201 depends on the camshaft side gear 19*a*'.

However, when the external diameter of the camshaft side gear 19*a*' is minimized, the camshaft 94 becomes diametrically smaller while the stress which the camshaft 94 receives from the plunger 7 or the like is large in the fuel injection pump 201 which is higher-pressurized in its fuel injection. If the camshaft 94 is supported only at its both end sides, the camshaft 94 may be warped.

Then, the fuel injection pump 201 of this embodiment is provided with a half-divided bearing 71 on which the camshaft 94 is supported at its peripheral surface opposite to the plunger 7 (lower surface in FIG. 3). The bearing 71 is shifted toward the middle of the camshaft 94 from both the journalled end portions of the camshaft 94 so as to be arranged in the vicinity of the cam 95.

As a consequence, the load which the camshaft 94 receives from the plunger 7 or the like can be received with the bearing 71, thereby preventing a warp in the camshaft 94 so as to decrease vibration and noise. Besides, the bevel gears 19' can be minimized so as to reduce the size of the fuel injection pump 201 on the whole.

Next, an outline of an engine system attached with the fuel injection pump 1 will be described.

Figure 10:
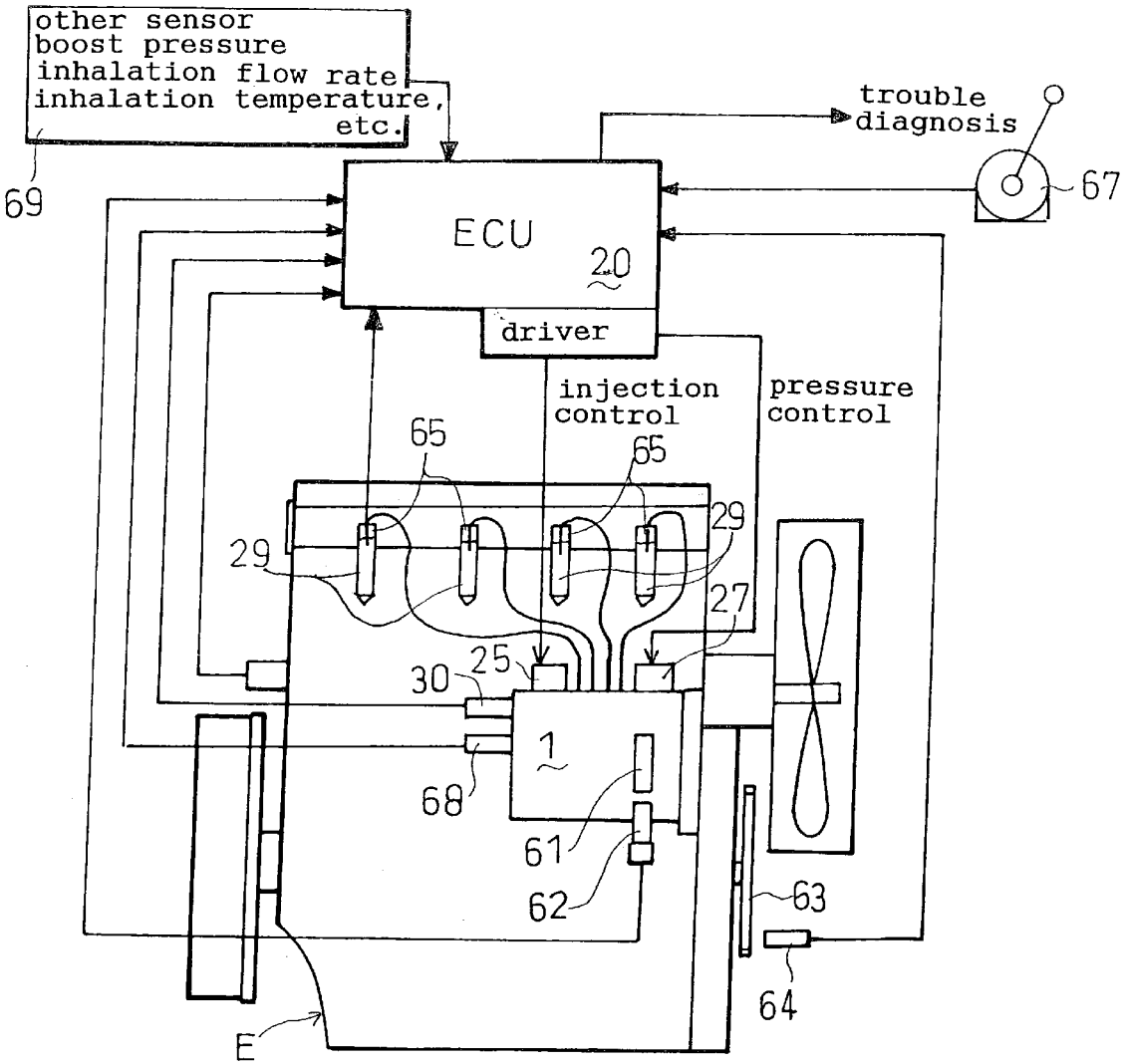
FIG. 10 is a schematic view showing an engine system attached with the fuel injection pump.

As shown in FIG. 10, the fuel injection pump 1 is attached on an engine E. In this system, to the ECU 20 are connected not only the pressure sensor 30, the pilot valve 25, and the pressure control valve 27 but also a fuel temperature sensor 68 attached on the fuel injection pump 1 and a cylinder differentiation sensor 62 which differentiates cylinders by using the cylinder differentiation pulsar 61 rotated integrally with the camshaft 4.

Furthermore, a water temperature sensor 66 for detecting the cooling water temperature of the engine E, a rotary speed sensor 64 for detecting the output rotary speed of the engine with a rotary detection pulsar 63 which integrally rotates with a crank shaft, and a lift sensor 65 for detecting the lift quantity of an injection nozzle 29 of each cylinder are also connected to the ECU 20.

Furthermore, to the ECU 20 are connected an acceleration sensor 67 and another sensor group 69 for detecting a boost pressure, an amount of inhalation flow, an inhalation temperature or the like.

Then, on the basis of the accelerator openness value detected by the accelerator sensor 67, the rotary speed value of the engine detected by the rotary speed sensor 64, the inner pressure value of the pressure accumulation chambers 31 detected by the pressure sensor 30 and the like, the operation of the pilot valve 25 and the pressure control valve 27 or the like, the ECU 20 electrically controls the operations of the pilot valve 25, the pressure control valve 27 and the like so as to let the injection nozzles 29 inject fuel in appropriate quantities, at appropriate timings and so on.

During this control, the cylinder differentiation sensor 62 differentiates the injection nozzle 29 to inject fuel among them, and the fuel injection condition is appropriately adjusted with the fuel temperature sensor 68, the water temperature sensor 66, the lift sensor 65 and the sensor group 69.

Furthermore, in preparation for the case where an unusual value is present in the detection value of each of the sensors, the ECU 20 is provided with a trouble diagnosis function to decide whether there is any trouble in the engine E or the fuel injection pump 1.

Alternatively, for differentiating cylinders, the cylinder differentiation pulsar 61 may be replaced with gears interlocking with the camshaft 4 such as the bevel gears 19.

Industrial Applicability

The pressure accumulating distribution type fuel injection pump of the present invention can be applied as a fuel injection pump of a diesel engine, and more particularly, it is more suitable as a fuel injection pump for a low pollution engine corresponding to the requests such as low fuel economy and regulation of exhaust emission.

What is claimed is:

1. A pressure accumulating distribution type fuel injection pump for distributively supplying respective cylinders with high-pressured fuel that is accumulated in a plurality of pressure accumulation chambers through distribution means, characterized in that function members constituting a high-pressure path, including a plunger, a pressure control valve for pressure control, an injection control valve for controlling fuel injection, the pressure accumulation chambers, and the distribution means, are arranged in a hydraulic base.

2. The pressure accumulating distribution type fuel injection pump according to claim 1, wherein a distribution shaft as the distribution means is arranged perpendicularly to a camshaft.

3. The pressure accumulating distribution type fuel injection pump according to claim 1, wherein the distribution shaft as the distribution means is driven with a camshaft.

4. A pressure accumulating distribution type fuel injection pump according to claim 1, wherein one plunger is provided for pressure accumulating fuel into the pressure accumulation chambers.

5. The pressure accumulating distribution type fuel injection pump according to claim 1, wherein a cam for driving the plunger is formed separately from a camshaft for supporting the cam.

6. The pressure accumulating distribution type fuel injection pump according to claim 4, wherein the camshaft is provided thereon with a pulse generating member for differentiation of cylinders, and wherein the pulse generating member is formed integrally with the cam.

7. A pressure accumulating distribution type fuel injection pump according to claim 1, wherein a rotary speed of a camshaft for driving the plunger for pressure-supplying fuel to a pressure accumulation chamber or the pressure accumulation chambers is set to the same as an output rotary speed of an engine on which the pressure accumulating distribution type fuel injection pump is attached, and wherein a rotary speed of the distribution means is set to a half of the output rotary speed of the engine.

8. The pressure accumulating distribution type fuel injection pump according to claim 7, wherein the distribution means is driven by the camshaft via bevel gears, and wherein the number of gear teeth of the bevel gear on the side of the distribution means is set to twice as large as the number of the gear teeth of the bevel gear on the side of the camshaft.

9. The pressure accumulating distribution type fuel injection pump according to claim 7, wherein both ends of the camshaft is supported with a housing, and wherein a bearing for supporting the peripheral surface of the camshaft on the opposite side of the plunger is shifted toward the middle portion of the camshaft from the portions thereof supported with the housing so as to be arranged in the vicinity of the cam.

10. The pressure accumulating distribution type fuel injection pump according to claim 1, wherein each of the plunger and the injection control valve serving as function members of a control system is arranged perpendicularly to a camshaft.

11. The pressure accumulating distribution type fuel injection pump according to claim 1, wherein each of the plunger, the distribution means and the injection control valve serving as function members of a control system is arranged perpendicularly to a camshaft.

12. The pressure accumulating distribution type fuel injection pump according to claim 11, wherein the plunger, the distribution means and the injection control valve serving as the function members of the control system are arranged in the direction of the camshaft in the order of the plunger, the distribution means, and the injection control valve.

13. The pressure accumulating distribution type fuel injection pump according to claim 12, wherein the plunger, the distribution means and the injection control valve are arranged in series.

14. The pressure accumulating distribution type fuel injection pump according to claim 11, wherein an electromagnetic valve for controlling the plunger and an electromagnetic valve for controlling the injection control valve are arranged on the end portion of the plunger and the end portion of the injection control valve, respectively.

15. The pressure accumulating distribution type fuel injection pump according to claim 14, wherein slide members of the electromagnetic valves slide perpendicular to the camshaft.

16. The pressure accumulating distribution type fuel injection pump according to claim 1, wherein a plurality of the pressure accumulation chambers are formed so as to be arranged in parallel to one another.

* * * * *